United States Patent [19]

Black

[11] 4,041,589

[45] Aug. 16, 1977

[54] BOBBIN LUGGER

[75] Inventor: Richard William Black, Manchester, Pa.

[73] Assignee: E. I. Du Pont de Nemours and Company, Wilmington, Del.

[21] Appl. No.: 616,021

[22] Filed: Sept. 23, 1975

[51] Int. Cl.[2] ..... B21B 15/00; B26D 1/06; B26D 5/14; B27F 7/24

[52] U.S. Cl. ..... 29/33 M; 29/564.6; 29/747; 29/755; 83/198; 83/580; 83/620; 227/97

[58] Field of Search ..... 29/33 M, 203 B, 203 D, 29/203 DS, 629, 747, 755, 564.6; 227/93, 95, 97, 98; 83/196, 198, 580, 620, 618, 613

[56] References Cited

U.S. PATENT DOCUMENTS 3,616,534 11/1971 Black ..... 29/203 B X

*Primary Examiner*—Othell M. Simpson

[57] ABSTRACT

A bobbin lugger having a feed assembly through which plural strips of edge-connected terminals are fed simultaneously until the end terminals are seated in grooves in a reciprocatably driven plate. As the plate is driven away from the feed assembly toward an intermediate station, the end terminals are severed. At the intermediate station, the terminals are simultaneously inserted in a bobbin, restrained in their inserted positions and then staked.

5 Claims, 15 Drawing Figures

LS1

LS-2
LS-3
8
8

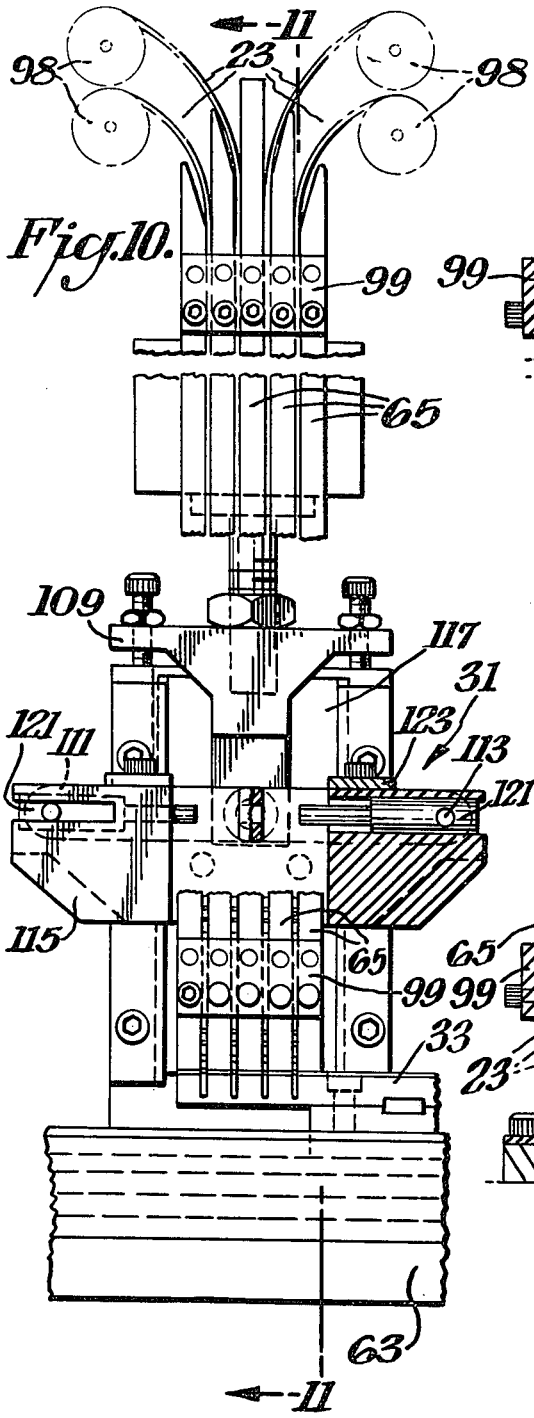
Fig. 10.
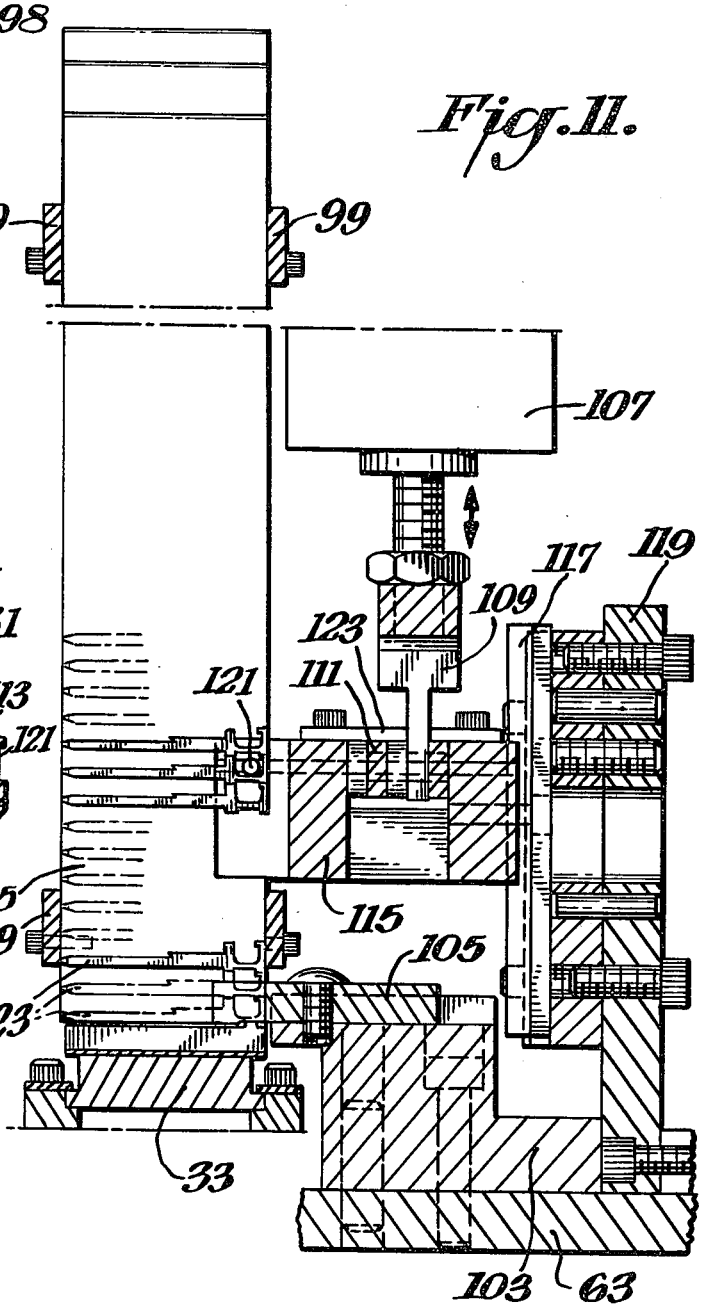
Fig. 11.
Fig. 11A.
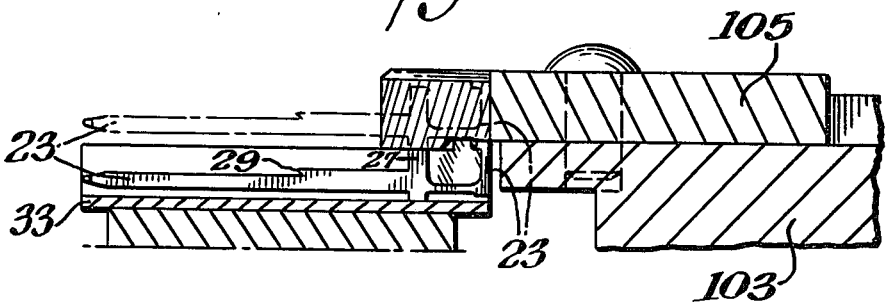

Pneumatic Lines
- Reset Lines
- Pilot Lines
- Feed Lines

BOBBIN LUGGER

BACKGROUND

This invention relates generally to the application of terminals to a plastic bobbin used as a component of an electrical coil and, more particularly, to an apparatus with which bobbins are lugged with an array of spaced, parallel terminals, each provided with an upstanding pin to which one end of a conductor in the coil can be tied.

An electrical coil of the type used in the communications industry or in the manufacture of solenoids includes a bobbin, usually of plastic, having flanges between which one or more insulated conductors are wound. Terminals are provided at one or both ends of the bobbin and usually are adapted for connection both to a tie from a conductor and to external circuitry. Strips of end-to-end connected terminals are used and the end terminal is not severed until after insertion. It is also a requirement that the inserted end be bent for accessibility to a tie from a conductor and, of course, each terminal must be staked or clinched in some way. These and related steps are usually carried out at multiple stations which leads to multiple opportunities for misalignments of operating parts and deformations of terminals.

SUMMARY

The apparatus of the present invention is a bobbin lugger having a station to which a flanged bobbin and plural terminals are advanced simultaneously from opposite directions and at which the terminals are inserted in the flange and staked. The apparatus includes an upright feed assembly having parallel slots each adapted for the passage therethrough of a strip of edge-connected terminals. A cut-off plate is normally positioned beneath the assembly and has a plurality of grooves, each in registry with a slot for seating the end terminal in a strip. The plate is mounted for sliding movement and is connected to a reciprocating drive which advances it to and from the inserting and staking station. In its normal position, the plate is located closely adjacent the feed assembly so that the end terminal from each strip will be severed as the plate is advanced toward the inserting and staking station.

DESCRIPTION OF DRAWINGS

Worthwhile objectives and advantages of the apparatus will be apparent from the following specification wherein reference is made to the accompanying drawings in which:

FIG. 10 is a fragmentary enlargement of the terminal-feeding assembly shown in FIG. 4, parts having been broken away or shown in section to reveal details of construction;

FIG. 11 is a sectional view taken on line 11—11 in FIG. 10;

FIG. 11A is a fragmentary, enlargement of the cut-off plates and terminals shown in FIG. 11;

DESCRIPTION OF PREFERRED EMBODIMENT

Figures 1, 2, 3:
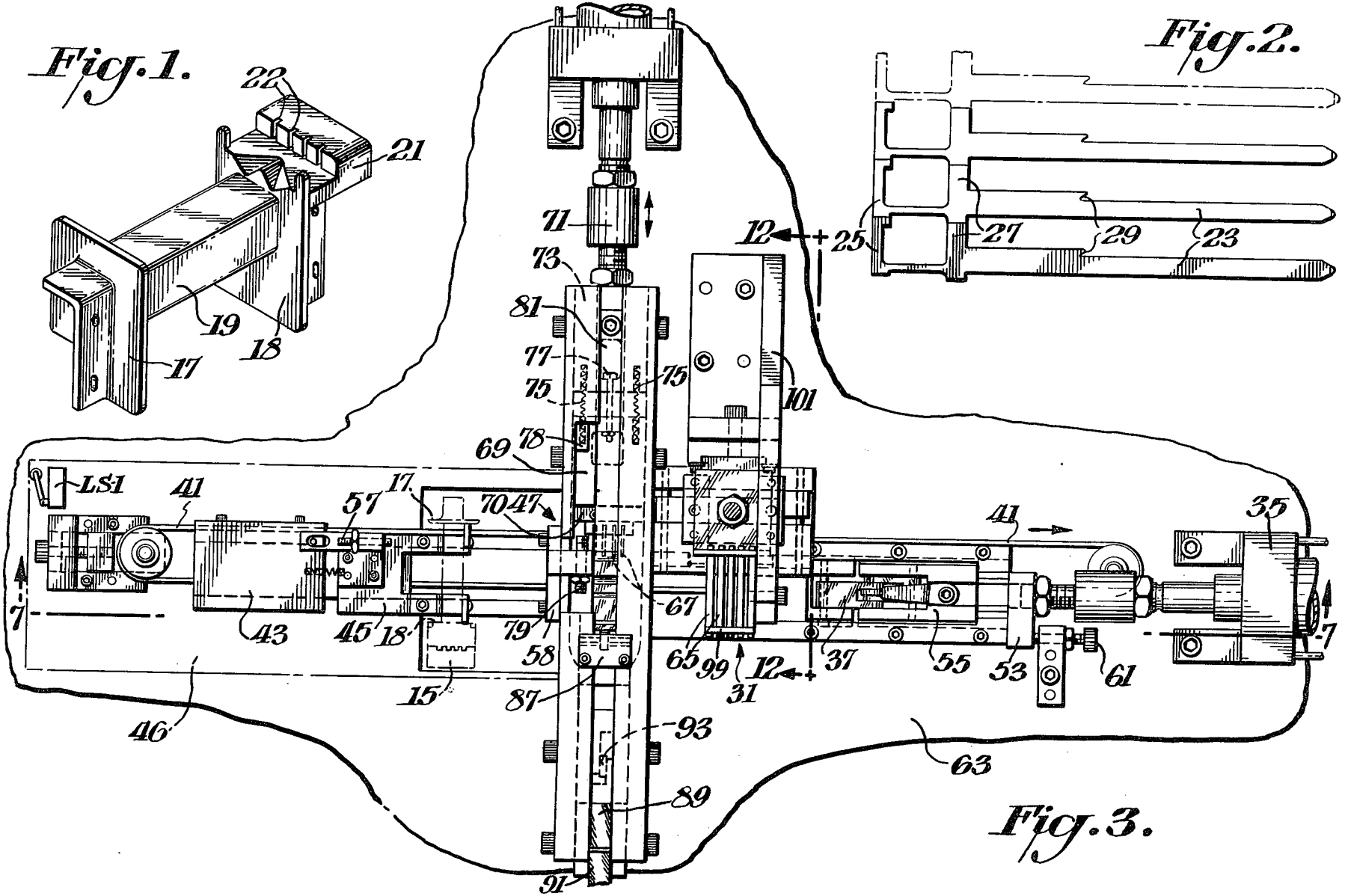
FIG. 1 is a perspective view of a bobbin.
FIG. 2 is a fragmentary, side view of a strip of edge-connected terminals.
FIGS. 3 and 4 are plan and front, elevational views of apparatus with which the terminals are applied to a bobbin.

Referring to FIG. 1, a bobbin 15 with flanges 17, 18 at the ends of a tubular body 19 has been chosen for purposes of illustration. The upper lip of flange 18 is cut away for access to an integral extension 21 provided with through apertures 22 adapted to receive terminals.

With the bobbin lugger disclosed herein, plural strips of the type shown in FIG. 2 are fed toward a grooved, cut-off plate in which end terminals 23 are seated before being severed and then advanced for insertion into slotted apertures 22. At one end, each terminal has an upstanding pin 25 to which a conductor can be tied. The other end is an elongated wire wrap through which the conductor can be connected to external circuitry. Intermediate its ends, each terminal 23 has a leg 27 which limits the extent of insertion and a barb 29 that is deformed when the terminal is staked.

Figures 4, 5, 9, 10A:
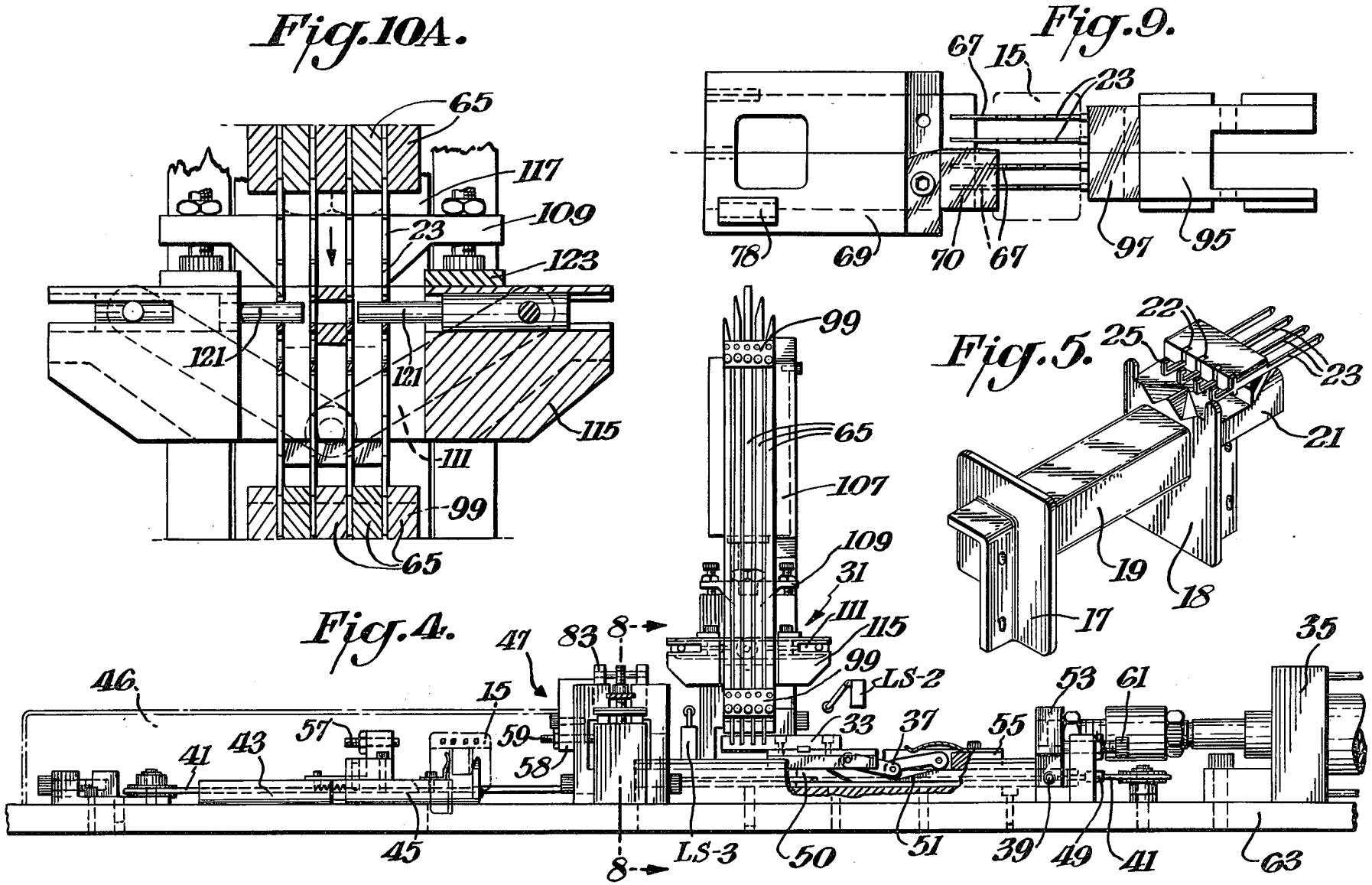
FIG. 5 is a perspective view of a bobbin lugged with terminals of the type shown in FIG. 2.
FIG. 9 is a fragmentary plan view corresponding to and showing parts in the same positions as in FIG. 8.
FIG. 10A is a fragmentary view corresponding to FIG. 10 except for movement of various parts to their terminal-feeding positions.

As shown in FIGS. 3 and 4, the apparatus which lugs flanged bobbins 15 with terminals 23 includes an upright feed assembly 31 through which plural strips of terminals are fed (FIG. 10) until the end terminals 23 are seated in grooves on the upper surface of a slideable cut-off plate 23. The plate 33 is reciprocatably driven from the rod of a pneumatic, piston-cylinder assembly 35 through a toggle linkage 37 and associated parts. The rod is also coupled at 39 to one reach of a steel belt 41 covered with nylon fabric. The other reach of belt 41 is clamped to a slide 43 which, in turn, is resiliently coupled to a bobbin slide 45. Bobbin slide 45 has spaced leaf springs and fingers for reception of the body 19 of a bobbin 15 and is shielded by a clear, plastic cover 46. As cover 46 is closed, it engages and closes a switch LS1 that is connected to assembly 35. Upon closure of LS1, the piston rod of assembly 35 is extended, the bobbin slide 45 and cut-off plate 33 advance simultaneously from opposite directions to an intermediate station 47 at which severed terminals 23 are inserted in apertures 22 of extension 21 on a bobbin 15 and the terminals are staked. Subsequently, upon retraction of the rod in assembly 35, the bobbin slide 45 and cut-off plate 33 are returned to the positions shown in FIGS. 3 and 4.

The staked bobbin is shown in FIG. 5. Pins 25 on terminals 23 do not project outwardly as far as the periphery of flange 18 and are located between the flange and the apertured portion of extension 21. Accordingly, pins 25 are protected but nevertheless readily accessible for a tie from a conductor. Apertures 22 correspond dimensionally to and each provides a close fit for the length of a terminal between its leg 27 and barb 29.

As noted above, cut-off plate 33 is driven from the rod of assembly 35 through toggle linkage 37 and associated parts. In this respect, cable 41 is also coupled at 39, 49 and 50 to a cut-off cam 51 which, upon extension of assembly 35, engages the knuckle of linkage 37 and extends the toggle, thereby imparting the first movement to cut-off plate 33 and severing end terminals 23 previously seated in the plate. Upward movement of the toggle linkage 37 is limited by a leaf spring. After extension of the toggle by cam 51, a plate 53 through which assembly 35 is coupled to cable 41 at 39 engages a toggle slide 55. Further extension of the rod in assembly 35 advances bobbin slide 45 and moves cut-off plate 33 to inserting station 47. These movements are limited by the engagement of an adjustable pin 57 on slide 45 with a stop plate 58 and by engagement of cut-off plate 33 with an adjustable stop pin 59 at station 47.

Figure 6:
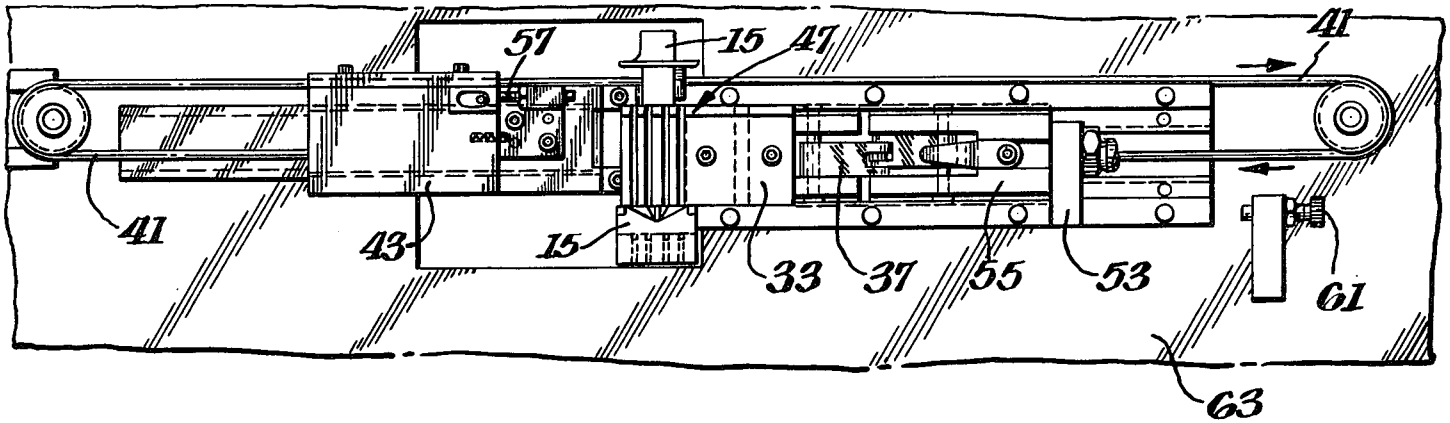
FIG. 6 is a fragmentary, plan view with various parts moved from the position shown in FIG. 3 to the station where terminals are inserted and staked.
Figure 7:
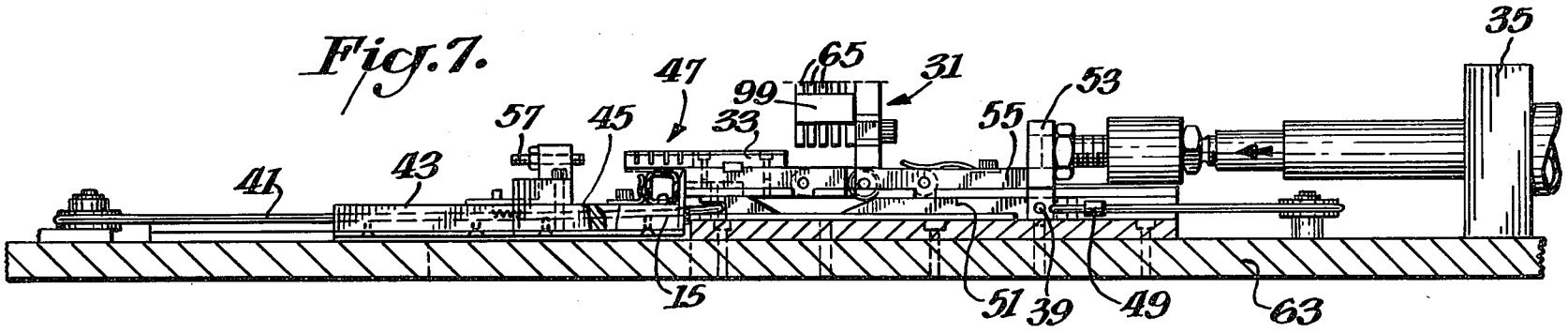
FIG. 7 is a fragmentary, sectional view taken on line 7—7 in FIG. 3 and also shows parts moved to the inserting and staking station.

When in engagement with the stop pin 59, cut-off plate 33 is nested between the flanges 17, 18 on bobbin 15, closely adjacent flange 18, as shown in FIGS. 6 and 7. Since the terminals are located between flanges 17, 18 before insertion, it is the elongated wire wrap that is inserted outwardly and there is no need to go through a separate bending step to present a post for a tie from a conductor. That purpose is served by the pins 25 on the terminals 23.

When nested at station 47, cut-off plate 33 has a terminal-seating groove aligned with each aperture 22. Seated terminals 23 are confined within the grooves in plate 33 and, accordingly, cannot be misaligned or bent. Insertion and staking will be described in connection with FIGS 8 and 9. When bobbin 15 has been lugged with terminals 23, assembly 35 is actuated, the parts are returned to their initial positions and the bobbin is replaced with an empty one.

Referring again to FIGS. 3 and 4, retraction of the rod in assembly 35 is limited by the engagement of plate 53 with an adjustable stop 61 mounted on base plate 63. Stop 61 is adjusted so that the grooves in plate 33 are in registry with parallel slots between a plurality of spaced bars 65 in upright feed assembly 31. The slots between bars 65 serve as tracks through which strips of terminals are stepped until the end terminal 23 in each strip is seated in a groove in plate 33. Details of the feed assembly 31 will be described in connection with FIGS. 10–12.

Figure 8:
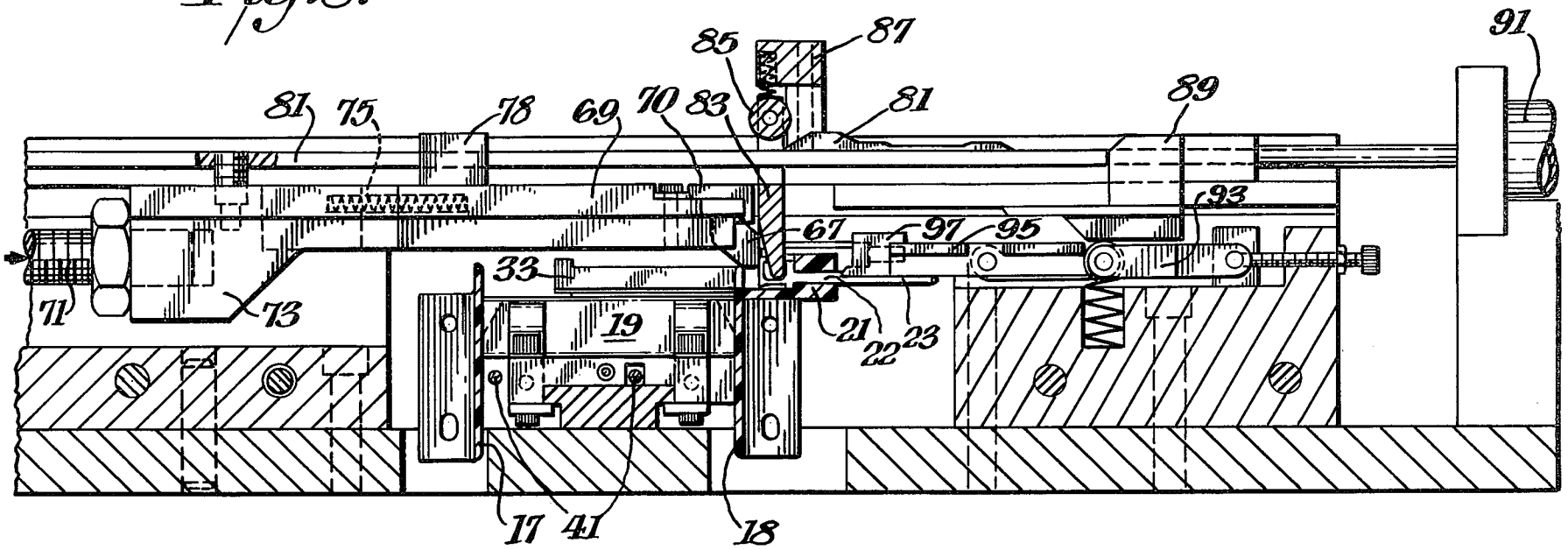
FIG. 8 is a fragmentary, enlarged, sectional view taken on line 8—8 in FIG. 4, but with parts moved to the staking position.

The mechanism for inserting and staking the terminals is illustrated in FIGS. 3, 4, 8 and 9. Referring specifically to FIGS. 8 and 9, terminals 23 are inserted into apertures 22 by blades 67 fitted into grooves at the end of a slide 69. Blades 67 have T-heads held in place by a retainer 70. Insertion slide 69 is coupled to the rod of a pneumatic, piston-cylinder assembly 71 by a drive block 73, a pair of springs 75, and a slip pin 77 (FIG. 3) which limits the separation of slide 69 and block 73. Slide 69 has a raised portion 78 engageable with an adjustable stop pin 79 (FIG. 3) on plate 58 to limit the insertion stroke and blades 67. A back-up cam 81 is fastened to and moves with the drive block 73. Upon extension of assembly 71, movement of slide 69 and blades 67 is limited by engagement of raised portion 78 with stop 79 but forward movement of back-up cam 81 continues against the bias of springs 75.

During insertion, terminals 23 are retrained against other than longitudinal movement by their confinement in the grooves in plate 33 and/or by their close fit in apertures 22 in bobbins 15. Since the terminals are confined within the grooves in plate 33 when severed and until inserted, there is no chance for misalignments or deformations. As the terminals are driven from the grooves in plate 33 by blades 67, a U-shaped back-up piece 83 is raised momentarily above the level of legs 27 on the terminals 23, against spring bias, by the engagement of back-up cam 81 with a ball bearing 85. The springs are held in place by a retainer 87 (omitted in FIG. 4) and function to return the back-up piece 83 to an operable position (FIG. 8) in which it engages legs 27 and prevents unseating of the inserted terminals during staking.

Upon completion of the inserting stroke, a staking cam 89 is driven by an associated, pneumatic, piston-cylinder assembly 91 into engagement with the knuckle of a toggle linkage 93 which has on link adjustably fixed and another link connected to a slide 95. At its free end, slide 95 carries a staking blade 97 adapted to engage and deform the barbs 29, thereby staking terminals 23 to bobbin 15. When the terminals have been staked, the piston rods of assemblies 71 and 91 are withdrawn and associated parts are returned to the positions shown in FIGS. 3 and 4.

Figure 12:
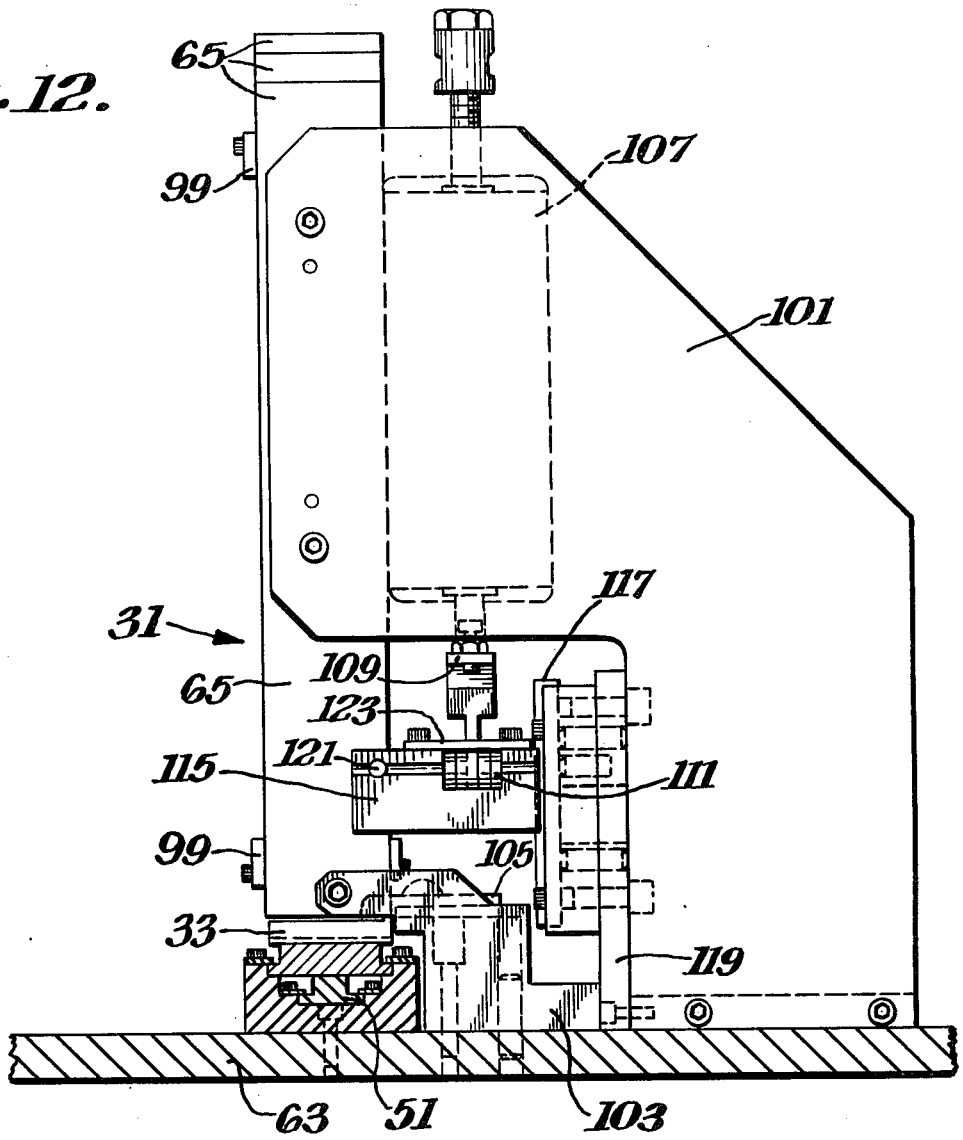
FIG. 12 is a sectional view taken on line 12—12 in FIG. 3, parts having been broken away to reveal additional details of the terminal-feeding assembly.

Referring to FIGS. 10–12, strips of terminals 23 are fed from reels 98 to the slots between spaced bars 65 until the end terminals are seated in grooved cut-off plate 33. Bars 65 are held in spaced relationship by upper and lower strips 99 and the right bar is fastened to an upright support 101 and a mounting block 103. Block 103 also supports an upper cut-off plate 105 which overlaps the slideable cut-off plate 33. At its overlapped end, plate 105 has grooves in registry with the terminal-feeding slots between bars 65 and is provided with a narrow ledge situated closely adjacent plate 33 at the location of legs 27 on terminals 23. Similarly, the overlapped end of plate 33 has an upturned ledge at the location of pins 25 on terminals 23. These ledges on plates 105, 33 cooperate to sever seated, end terminals 23 at the scores shown in FIG. 2.

Feed assembly 31 has a pneumatic, piston-cylinder assembly 107 mounted on support 101. The piston rod is fastened through a drive link 109 to the pin which interconnects two toggle links 111. The outer ends of links 111 carry pins 113 that are slideable in slots provided therefor in a feed housing 115 as drive link 109 moves downwardly. Housing 115 is attached to a slide 117 mounted in tracks provided on an upright support 119. The pins at the outer ends of the toggle links 111 are connected to pins 121 which move into the space between pins 25 and legs 27 of terminals 23 as the toggle links 111 are collapsed. Relative movement between drive link 109 and feed housing 115 is limited by engagement of adjustable stops on link 109 with plates 123 on housing 115. Continued movement of the piston rod drives housing 115 downwardly into engagement with the rolls of switches LS2 and LS3 (FIG. 4). Switch LS2 is connected to a normally open valve in the feed line to the extension port in assembly 35 and switch LS3 is connected to a normally closed valve in the feed line to the extension port of assembly 91 (FIG. 13), i.e., with the piston in assembly 107 extended, assembly 35 can be extended but assembly 91 is disabled. As assembly 107 is extended, the strips are advanced until the end terminals 23 have been seated in the grooves in cut-off plate 33. It is the cooperation between drive link 109, toggle links 111 and pins 121 that facilitates the simultaneous advance of plural strips of edge-to-edge connected terminals. Once the end terminals are seated in plate 33, the piston rod in assembly 107 remains in its normally extended position until the rod in assembly 71 is extended in an inserting stroke.

After insertion of terminals 23 in bobbin 15 and responsive to the extension of assembly 71, the piston in assembly 107 is retracted, withdraws pins 121 and raises housing 115. Retraction of the piston in assembly 107 also reverses the positions of switches LS2 and LS3, thus disabling piston-cylinder assembly 35 and enabling piston-cylinder assembly 91. When the parts connected to assembly 107 reach the retracted positions shown in FIGS. 10 and 11, a reversing valve in assembly 107 has initiated retraction of the rods in assemblies 71 and 91. A reversing valve in assembly 71 initiates retraction of the rod in assembly 35 and a valve in assembly 35 in turn initiates the extension of assembly 107 in its feeding stroke, i.e., a return to its normally extended position.

The apparatus is readied for operation by positioning plural reels of terminals (FIG. 10) and advancing the respective strips down the tracks between bars 65 into engagement with the feed pins 121. Several cycles are then required to seat an end terminal 23 in each groove of cut-off plate 33. At this time, the piston rods in assemblies 35, 71 and 91 are retracted and the rod in assembly 107 is extended. The operator places an empty bobbin 15 between the leaf springs and fingers on bobbin slide 45 and closes cover 46.

Figure 13:
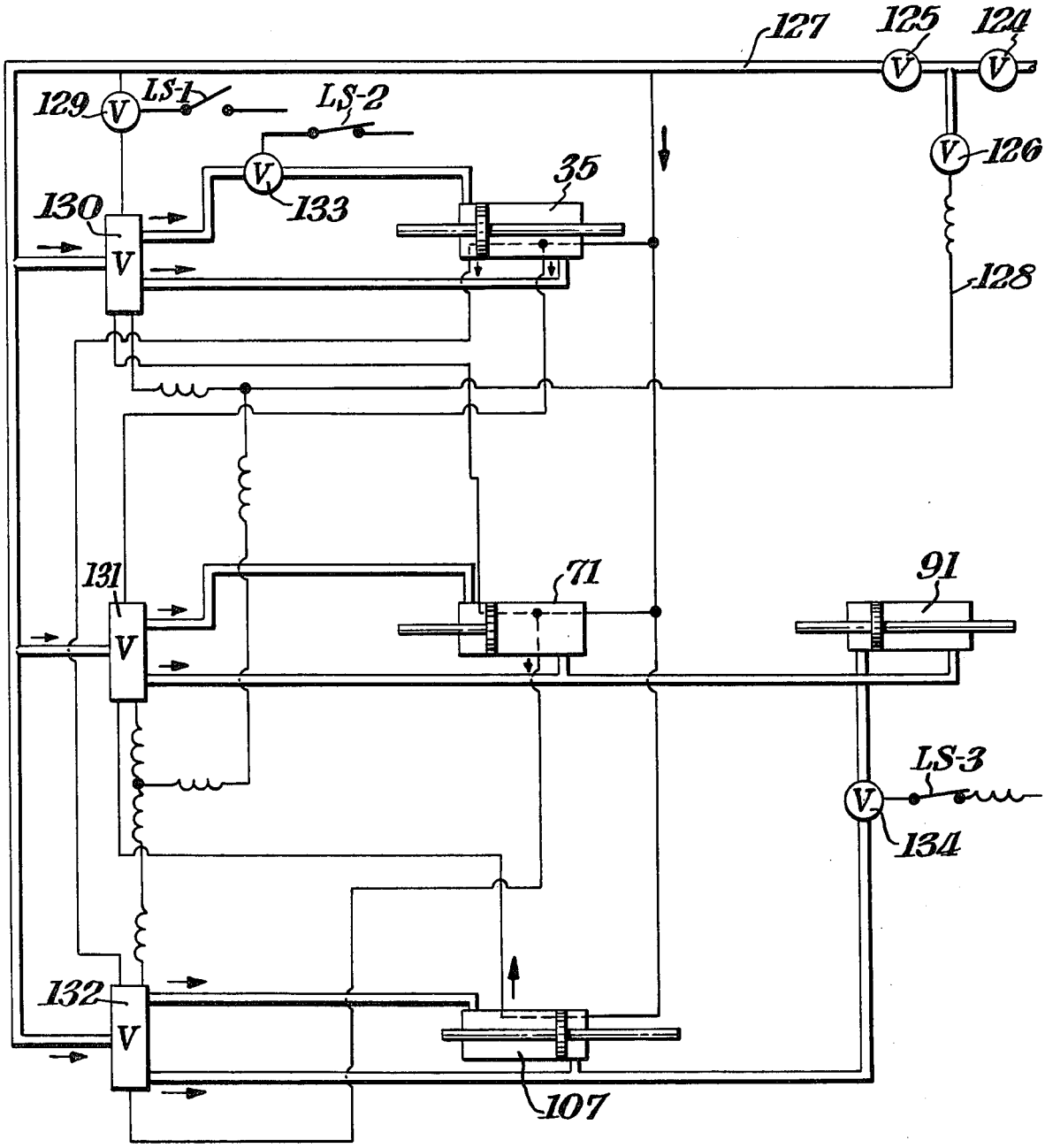
FIG. 13 is a schematic illustration of the pneumatic control system for the bobbin lugger disclosed herein.

Referring now to FIG. 13, the pneumatic system includes a shuttle valve 124, a toggle valve 125 and a control valve 126 through which air is supplied to service hose 127 and reset line 128. With valves 124, 125 open and valve 126 closed, actuation of switch LS1 responsive to closure of cover 46 opens a blocking valve 129 connected to a valve 130 in the feed line to the extension end of the cylinder in assembly 35, leading to extension of the rod, movement of bobbin 15 and cut-off plate 33 to station 47 and operation of an associated internal air switch or reversing valve which is connected to a valve 131 in the feed line to the extension end of the cylinder in assembly 71 and causes its extension. Extension of the rod in assembly 71 operates an associated internal air switch connected to a valve 132 in the feed lines to the retraction end of the cylinder in assembly 107 and to the extension end of the cylinder in assembly 91. Upon retraction of the rod in assembly 107, feed housing 115 moves upwardly and disengages switches LS2 and LS3 which are connected to a normally open valve 133 and a normally closed valve 134, respectively. Then, the rod in assembly 91 is extended in a staking stroke. Assembly 107 also has an associated internal air switch which is connected to valve 131 in the feed line to the retraction ends of the cylinders in assemblies 71 and 91. Upon retraction of assembly 107, valve 131 is opened to the retraction ends of assemblies 71 and 91. Upon retraction of the rod in assembly 71, another internal air switch is reversed and, in turn, reverses valve 130, leading to retraction of the rod in assembly 35. Another internal air switch in assembly 35 is connected to valve 132 in the feed line to the extension end of assembly 107 and, upon retraction of assembly 35, causes extension of the rod in assembly 107. Extension of the rod in assembly 107 moves housing 115 and associated parts through a feed stroke. In that stroke, the housing engages switches LS2 and LS3. Closure of switch LS3 opens valve 134, thus permitting extension of the rod of assembly 91 in a staking stroke. Closure of switch LS2 closes valve 133, thus disabling assembly 35 until assembly 107 has been extended in a terminal-feeding stroke. At that time, the apparatus is ready for another cycle which is initiated when the operator closes cover 46 after replacing a lugged bobbin 15 with an empty one.

What is claimed is:

1. In a bobbin lugger having a station to which a flanged bobbin and plural terminals are advanced simultaneously from opposite directions and at which the terminals are inserted and staked, an upright feed assembly having plural slots, each adapted for the passage therethrough of a strip of edge-connected terminals, a plate normally positioned beneath said assembly, said plate having a plurality of grooves, each in registry with a slot for receiving the last terminal in a strip, means mounting said plate for sliding movement, and a reciprocating drive connected to the plate for advancing it to and from said station, said plate being adjacent said assembly when in the normal position and thereby adapted to sever the last terminal from each strip as it advances toward said station.

2. The bobbin lugger of claim 1 wherein said reciprocating drive includes a driven cam and a toggle linkage within the path of and extendible by said cam, said plate being connected to the toggle linkage and slideable relative to the cam.

3. The bobbin lugger of claim 2 wherein said reciprocating drive includes a bobbin-receiving slide and an endless cable, said slide and said cam being connected to opposite reaches of said cable.

4. The bobbin lugger of claim 1 wherein said feed assembly is comprised of spaced bars presenting said slots, a feed housing slideable relative to said bars, a pair of feed pins mounted in said housing for movement to and from positions between successive terminals in each strip, a toggle linkage connected to the pins and a second reciprocating drive connected to the toggle linkage for sequentially collapsing the linkage, moving the pins to said positions and then sliding the housing toward said grooved plate.

5. In a bobbin lugger having a station to which a flanged bobbin and a plate with grooves for seating plural terminals are advanced simultaneously from opposite directions and at which the terminals are inserted and staked, an upright feed assembly comprised of spaced bars presenting slots each adapted for the passage therethrough of a strip of edge-connected terminals, a feed housing reciprocatable relative to said bars, a pair of feed pins mounted in said housing for movement to and from positions between successive terminals in each strip, a toggle linkage connected to the pins, and a reciprocating drive connected to the toggle linkage for sequentially collapsing the linkage, moving the pins to said position, and then moving the housing toward said grooved plate, said plate being normally positioned beneath and adjacent said bars, with a groove in registry with each slot, whereby to seat the last terminal in each strip and to sever it as the plate is advanced to said station.

* * * * *